United States Patent [19]

Bredo

[11] 4,392,259

[45] Jul. 12, 1983

[54] TROUSER CONSTRUCTION

[76] Inventor: Guido Bredo, No. 3, Via di Sant'Eustacchio, 00186 Rome, Italy

[21] Appl. No.: 176,227

[22] Filed: Aug. 7, 1980

[30] Foreign Application Priority Data

Aug. 29, 1979 [IT] Italy ..... 50127 A/79
Mar. 12, 1980 [IT] Italy ..... 48145 A/80

[51] Int. Cl.[3] ..... A41D 1/06
[52] U.S. Cl. ..... 2/227
[58] Field of Search ..... 2/227, 243 B, 228, 234, 2/238, 407, 409

[56] References Cited

U.S. PATENT DOCUMENTS

| | | | |
|---|---|---|---|
| 478,190 | 7/1892 | Hamilton et al. | 2/227 |
| 478,195 | 7/1892 | Lewis et al. | 2/227 |
| 478,281 | 7/1892 | Hamilton et al. | 2/227 |
| 924,013 | 6/1909 | Stecker | 2/227 |
| 1,277,700 | 9/1918 | Decker et al. | 2/407 |
| 2,285,692 | 6/1942 | Wickman | 2/227 |
| 2,355,745 | 8/1942 | Netzky | 2/227 |
| 2,417,529 | 3/1947 | Terry | 2/227 |
| 2,668,957 | 2/1954 | Schmidt | 2/227 |
| 2,697,925 | 12/1954 | Goodman | 2/409 X |
| 2,702,545 | 2/1955 | Orr | 2/227 X |
| 3,745,589 | 7/1973 | Borsing | 2/227 |
| 3,763,498 | 10/1973 | Rector | 2/227 X |
| 3,793,646 | 2/1974 | Tempelhof | 2/227 |
| 4,004,297 | 1/1977 | Polack | 2/227 |

*Primary Examiner*—H. Hampton Hunter
*Attorney, Agent, or Firm*—Beveridge, DeGrandi & Kline

[57] ABSTRACT

The invention relates to an anatomic trouser construction which comprises five parts, in which the fifth part added is joined onto a new shape of the four conventional parts forming a structure which gives the crotch a shape apt to the anatomy both of men and women, avoiding in particular all the inconveniences which arise in the static or movement positions, in which the legs are bent with respect to the trunk, and the converse, and avoids moreover the trousers being subject to the deformations or yieldings as occur in conventional structure which is not arranged to avoid the great strains caused by the movements of the wearer along the sewing lines.

19 Claims, 9 Drawing Figures

TROUSER CONSTRUCTION

BACKGROUND OF THE INVENTION

The present invention relates to a new trouser construction which is directed to avoid the inconveniences of conventional trouser constructions.

The aim of the present invention is to provide a new improved trouser construction, particularly directed to a new construction of the crotch area in order to provide trousers which fit both men and women and which overcome the inconveniences deriving from known trouser constructions.

The problem of providing an improved trouser construction, particularly in the crotch area is well-known. The problem is known by experts in the field and several attempts have been made in the past to solve it. Known attempts to solve the problem of an improved trouser construction particularly in the crotch area are exemplified by the following U.S. patent publications:

U.S. Pat. No. 478,190, Hamilton et al
U.S. Pat. No. 924,013, Stecker
U.S. Pat. No. 1,277,700, Decker et al
U.S. Pat. No. 2,285,692, Wickman
U.S. Pat. No. 2,355,745, Netzky
U.S. Pat. No. 2,697,925, Goodman
U.S. Pat. No. 2,702,545, Orr
U.S. Pat. No. 3,745,589, Borsing
U.S. Pat. No. 3,763,498, Rector
U.S. Pat. No. 3,793,646, Tempelhof
U.S. Pat. No. 4,004,297, Polack In the present patent application there are disclosed in detail all the patterns which the fifth part in combination with the two parts constituting the front parts of the trousers may assume to form an overall combination having a fixed extension with the extension of the fifth added part which increases with the decrease of the extension of the two front parts, and the converse. The whole is obtained by joining the parts along two interior anatomic lines which begin at the two sides of the navel and join each other under the sacrum.

In this way the fifth added part will have a minimum extension and a triangular shape when the two parts which constitute the front of the trouser, taken together, have a maximum extension; and it will have a maximum extension and a shape somewhat recalling an inverted bottle when the two front parts taken together have a minimum extension.

Between the two anatomic lines, in the field defined by said minimum and maximum extensions and by said limiting shapes, the fifth added part may have, obviously, any extension and may assume a shape according to the various industrial and/or aesthetical needs which may arise, while the overall extension of the five parts remain unchanged.

What is said above will be disclosed in detail in the following with reference to the attached drawings.

The advantages of the new constructions may be summarized as follows:

(a) A greater wearability over time because the original shape stays undeformed, because there is provided:

(1) the maximum elasticity of the cloth of the two front parts in registry with the internal sewing; the front parts are cut entirely along a slant line with a consequent natural adjustment to the changes of dimensions or shape of the thighs during movements particularly those which are made for sitting or lifting;

(2) the maximum rigidity of the cloth of the two parts making up the back parts is in registry with the internal sewing which in said parts is along the threads so that the back part of the trousers maintains its original shape even after prolonged use.

(b) A great improvement of the overall aesthetics

Indeed, since the structure has a greater harmony with the anatomic configuration it allows:

(1) The avoidance of laterally increasing the prominence of the abdomen along the vertical of the belly button; and (2) the avoidance of cloth yields under the buttocks forming the well-known ugly "bags".

(c) A greater functionality (1) By eliminating completely the stresses which existed along the central crotch seam and providing a completely anatomic crotch, there is provided a greater "elasticity" to the trousers making it much easier to move and also allowing very complex movements. It should be remarked in this respect, that while walking, the new arrangement of the crotch tends to push the trousers upwards in a way which is exactly the contrary of what occurs with the cut of conventional trousers which tend to go down in correspondence with the crotch when the wearer is walking.

(2) By eliminating, (in the lateral version) the rigidity along the vertical of the belly button caused by the central fly of the conventional trousers, the cloth in that area is more adjustable to the changes of dimensions of the abdomen.

(d) A greater resistance is provided by eliminating any pull on the cloth in the crotch area (particularly in the seated position), avoiding the yielding of the cloth along the sewing of conventional trousers which because of such yielding needed a particular reinforcement by lining in this area.

(e) Hygiene is enhanced thanks to the absence of any compression or friction action on both masculine and feminine genitals eliminating any inconvenience or trouble which may derive from this compression or friction.

It is therefore a main object of the invention that of providing trousers having a structure novel with respect to the known art, said new structure being completely free of the inconveniences and disadvantages of the old structure.

SUMMARY OF THE INVENTION

The foregoing advantages are provided by my new trouser construction which includes right and left front parts and right and left rear parts for covering the respective front and rear of a wearer's right and left hip and thigh. Each rear part has a top edge, a bottom edge, an outer edge extending substantially continuously between the top and bottom edges, a lower inner edge extending from the bottom edge to a region corresponding to the sacrum of the wearer and an upper inner edge extending from the region corresponding to the sacrum to the top edge. Each front part has a central portion, a top edge, a bottom edge, an outer edge extending substantially continuously between the top and bottom edges, a lower inner edge extending from the bottom edge to the region of the sacrum of the wearer, the lower inner edge slanting away from the central portion in the region of the thigh of the wearer, a concave crotch edge extending from the region of the sacrum toward the central portion, and an upper inner edge extending from the crotch edge to said top edge. The trousers include an elongated crotch piece having a multiplicity of sides including elongated right and left continuous concave sides converging at one end thereof in an acute angle; the remainder of the sides form a crotch piece top. The right and left front parts have their upper inner edges shaped for complementary construction with the crotch piece top across the abdomen of the wearer.

The right front and rear parts are joined by a right outer seam along their outer edges and by a right inseam along their lower inner edges, the left front and rear parts are joined by a left outer seam along their outer edges and by a left inseam along their lower inner edges, and the right and left rear parts are joined by a back seam along their upper inner edges. The right front part is joined to the crotch piece by a right crotch joint along the crotch edge of the right front part and the right converging side of the crotch piece, and the left front part is joined to the crotch piece by a left crotch joint along the crotch edge of the left front part and the left converging side of the crotch piece.

As a result of this construction, the back seam, the inseams and the crotch joints converge in the region of the sacrum, with the acute angle of the converging sides of the crotch piece pointing rearwardly and the right and left crotch joints extending along anatomical lines from the sacrum to positions on the sides of the navel of the wearer.

The right and left front parts have their upper edges joined with the crotch piece top in complementary construction across the abdomen of the wearer. The arrangement of the front parts and crotch piece top can take several forms.

BRIEF DESCRIPTION OF THE DRAWINGS

The invention will be now disclosed in detail with reference to the attached drawings, wherein.

DETAILED DESCRIPTION

It should be remarked that in the several figures the shown contours are those in which no account is made for the margins necessary for sewing. Consequently, what in them appears as a crescent-shaped cavity, is practically a simple cut.

Figure 1:
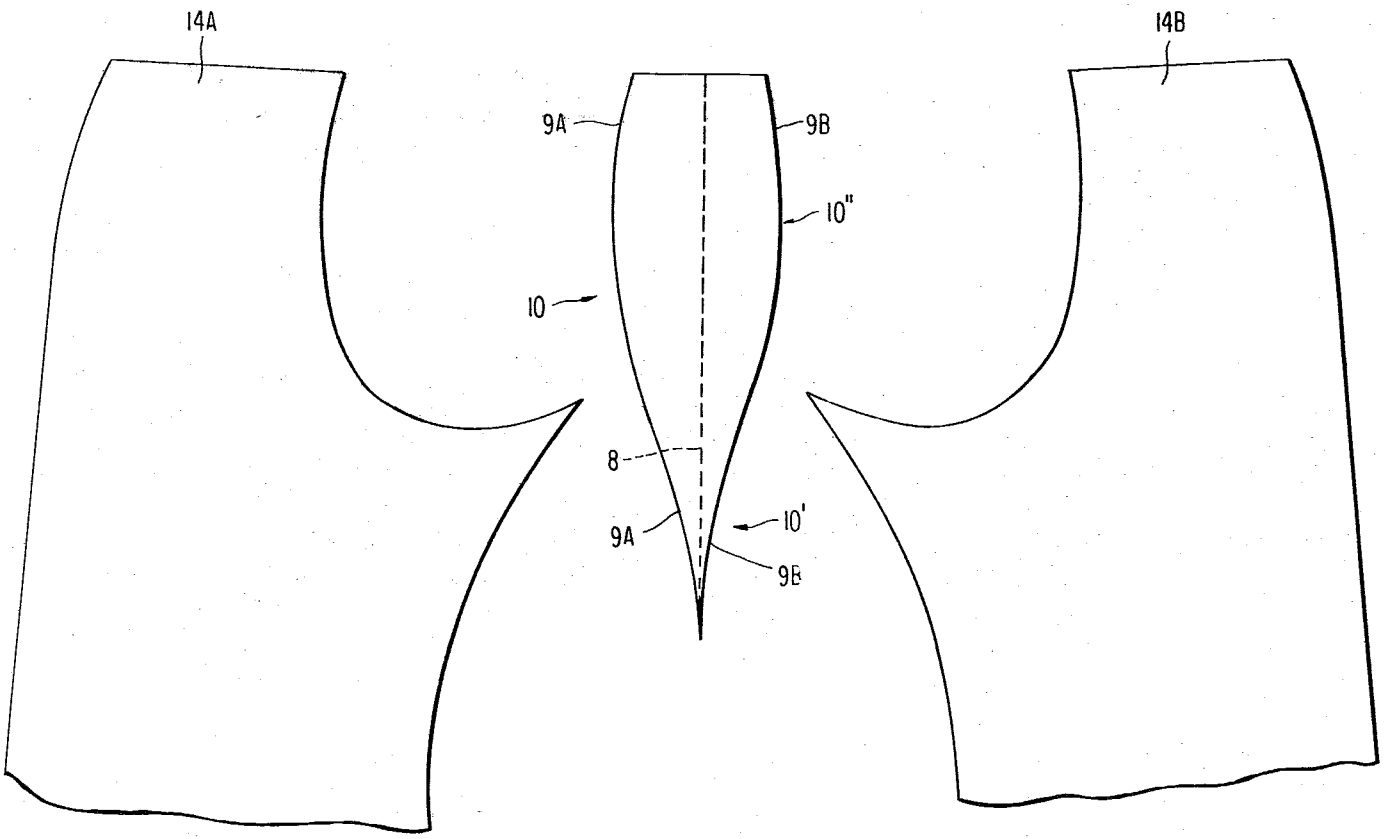
FIG. 1 is a partial view of the two parts making up the front part of trousers and of the fifth added part according to one embodiment.

In FIG. 1 there is shown schematically the manner in which, in the new construction according to the invention, the fifth part or crotch part 10 may have a maximum extension in which it assumes a contour somewhat resembling the outline of an inverted bottle with a pointed neck indicated with 10'', defined by the anatomic lines above mentioned indicated with 9A and 9B.

The cloth covering the abdomen of the wearer may be a part to a greater or lesser extent of the two front parts or of the fifth added part indicated with 10'' in FIG. 1.

In another possible embodiment, the fifth part has a minimum size according to which it has the shape of a triangle with sides of differing lengths. There are shown the left handed and right handed versions with an opening correspondingly displaced according to whether the triangular fifth part is sewn with two of its sides to the left front part (FIG. 2) or the right front part (FIG. 3).

Figure 8:
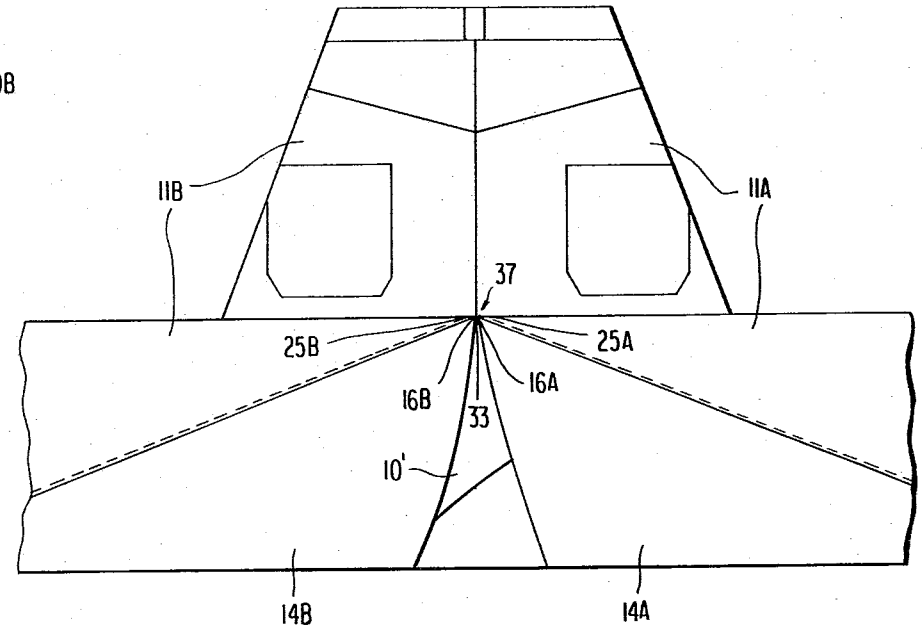
FIG. 8 shows sewn trousers, having generally the structure according to the invention and illustrating the location of the fifth part.

In the left handed embodiment it will be seen that the fifth part or added part 10' is united to the left front part 14B of the trousers and more precisely, the top or upper margin 32 of the part 10' is united to the lateral edge defined by upper margin 34D of the curved cut 35 made in the part 14B as a continuation in it of the crotch edge or margin 28'B which starts from the apex 16B. In the sewn trousers the shorter side 31A of crotch piece 10' is united to the crotch edge 28'A of the side 28A which corresponds to the part 28'B and the longer side 31B is united to the lower part 28'B of the side 28B and to the lower side 34E of the cut 35. Moreover, in the finished trousers, as it is usual, the top edges 21 (A,B) of the two front parts 124 (A,B) and those indicated with 27 (A,B) of the two rear parts 11 (A,B) (FIG. 7) will be sewn to the part constituting the waist band, the outer edges 20 (A,B) of the two rear parts 11 (A,B) and the two front parts 24 (A,B) will be united together. Also there will be united together their inner edges 24 (A,B) and 29, (A,B) to form inseams whilst the two upper inner edges 24'A and 24'B of the two rear parts will be sewn together in a back seam so that the five apexes 25 (A,B), 16 (A,B) and 33 (FIG. 2) will be united at the point 37. (FIG. 8).

Figure 3:
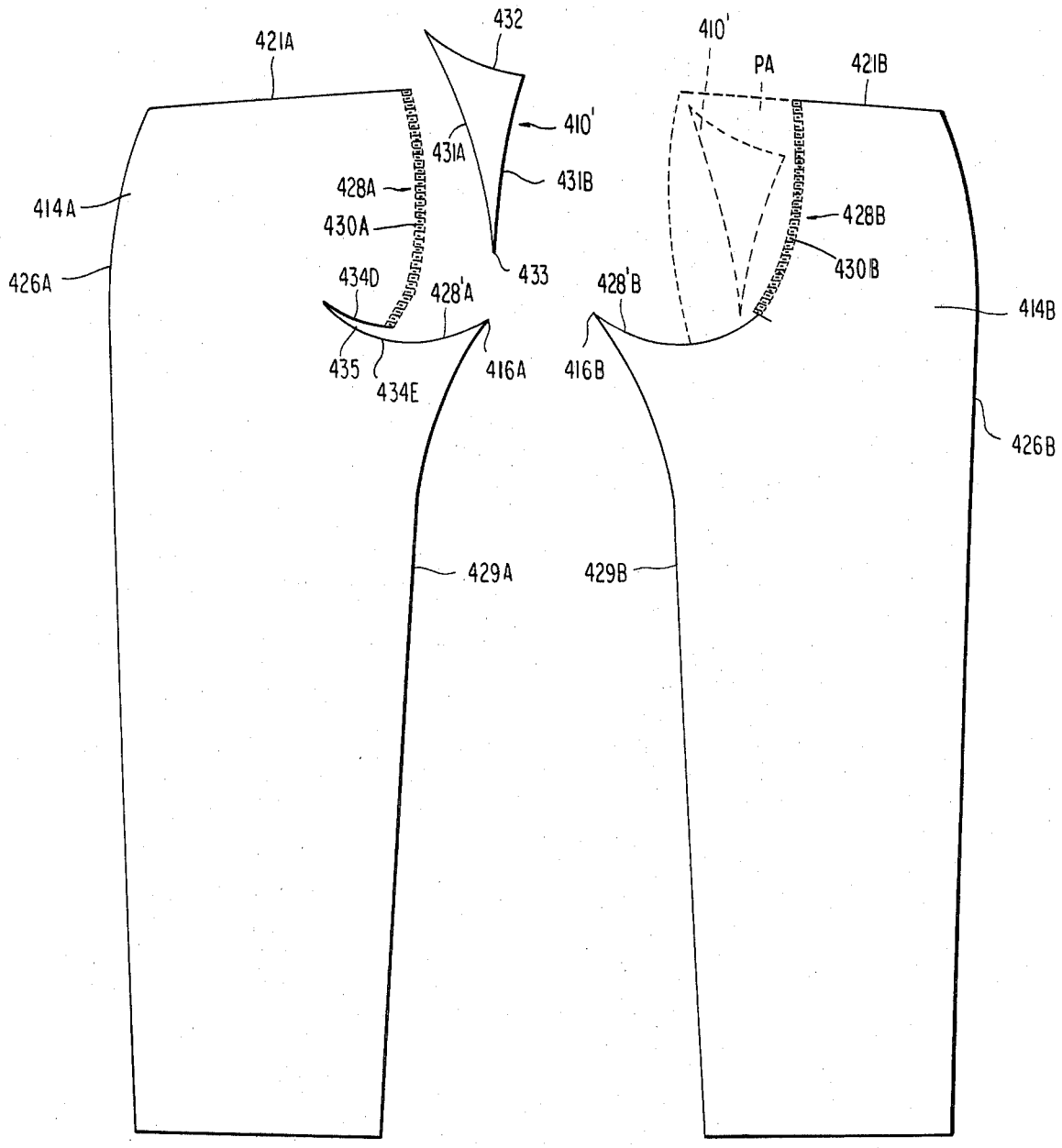
FIG. 3 is a view similar to FIG. 2 but in the right handed embodiment with opening of the trousers vertical and to the left.

As it will be clear studying FIG. 3, in which for indicating the several parts the same reference numbers are used which were used for the left handed embodiment increased by 400, in respect of the right handed embodiment, in this embodiment one may apply, after suitable changes all of what has been already disclosed when describing the left handed embodiment of same.

Figure 2:
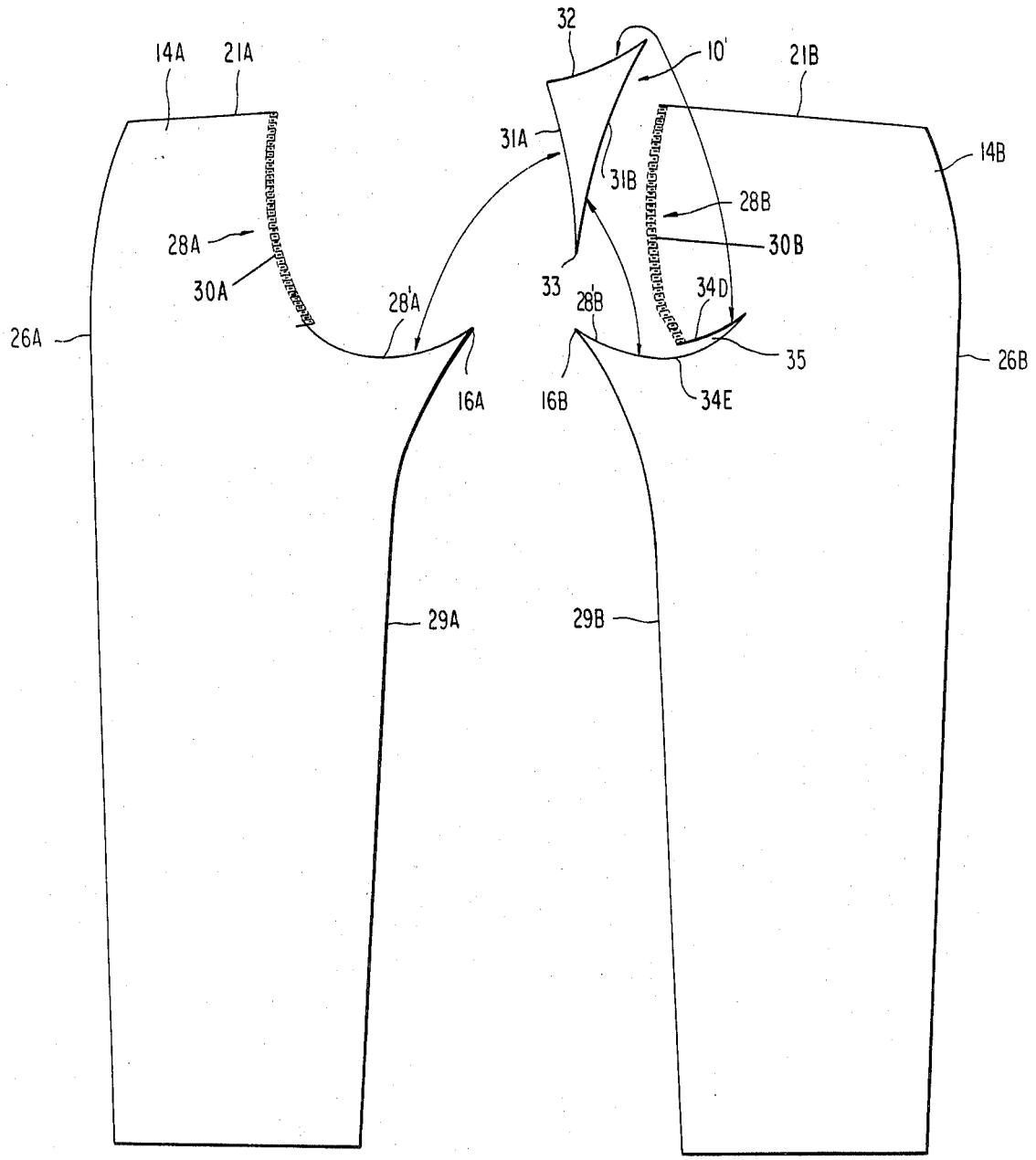
FIG. 2 is a complete view, on a smaller scale, of the two front parts with a maximum extension and of the fifth added part having a minimum extension in a left handed embodiment with an opening of the trousers vertical and to the right.

The crotch piece in FIG. 3 as indicated with 410' is a triangle with unequal aides but is the mirror image of the part 10' shown in FIG. 2.

In this right handed version, the cut 435 will be made in the right front part 414A as a continuation of the crotch edge 428'A; the top 432 of the crotch piece 410' will be united to the lateral edge 434D of the cut 435; the long side 431A will be united to the right front part 414A and more precisely to the crotch edge 434E of the cut 435 and to the prolongation of the same 428'A up to the apex 416A and its shorter side 431B will be united to the crotch edge 428'B of the left front part 414B for all its length starting from the apex 416B.

Finally, as has already been detailed, in both embodiments of this case, the closure, whose sides 28A, 28B, 428A and 428B are provided with the parts of a zipper indicated with the reference numbers 30A, 30B and 430A, 430B, respectively will be shifted laterally to the right or to the left with respect to the central part of the trousers and will extend from the waist band down to the upper part of the fifth part or beyond. This may be easily derived from the figures where one may see that such closure may, moreover, have a length greater than that of the presently used closures, and this undoubtedly constitutes a further advantage of the structure according to the invention.

From FIG. 3 one may appreciate another advantageous feature of the invention directed to the industrial production of of trousers according to the invention. After having cut up all the front parts, both right and left, 414 (A,B) including the contour of the right front part 414A, the fifth added part 410' is obtained from the part of cloth PA which has to be taken out from the left front part 414B eliminating therefore any waste of cloth.

This has been made clear by showing with dotted lines the part PA to be taken out from the left front part 414A in FIG. 3 and by representing within it by a dotted line the crotch piece 410'. As will be apparent, the same technique can be used for trousers according to FIG. 2.

Figure 4:
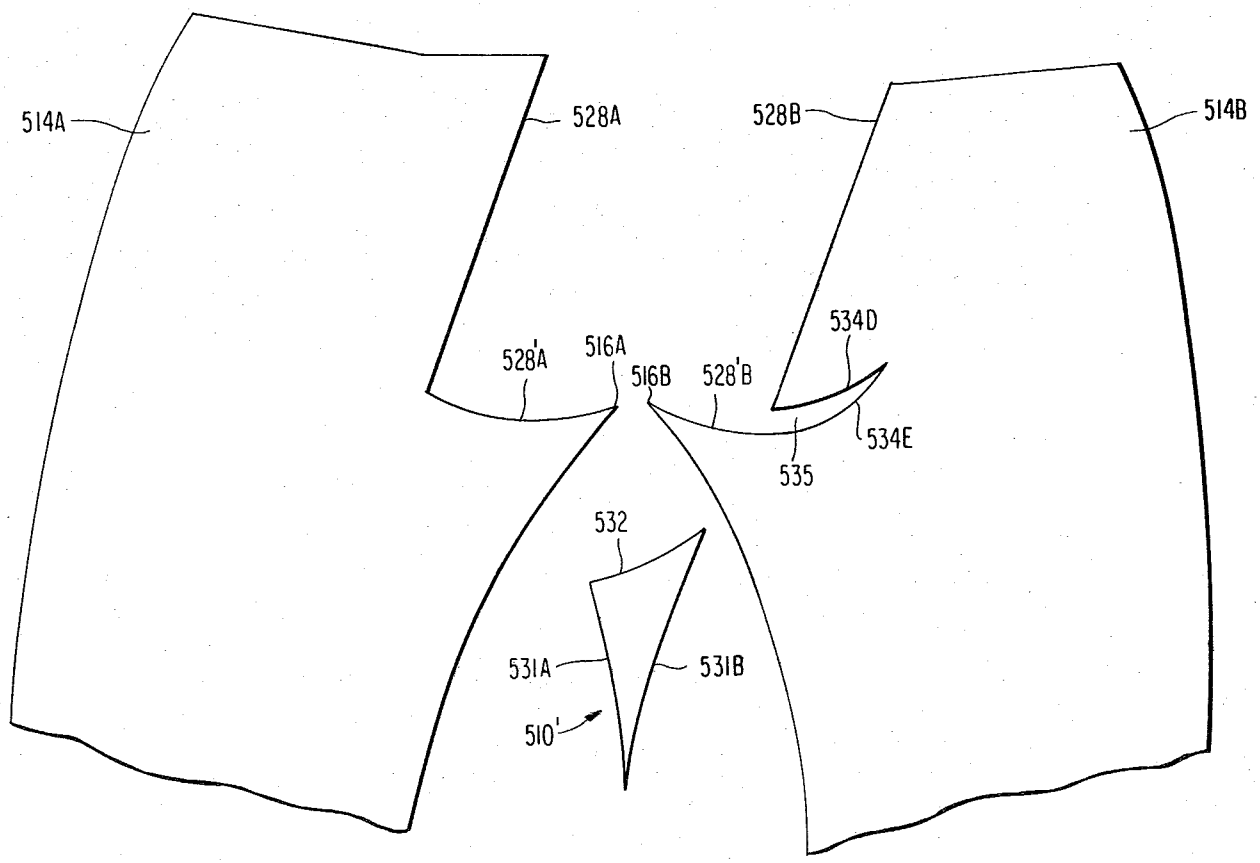
FIG. 4 is a view similar to the one of FIG. 1 of a fifth added part having a minimum extension in the left handed embodiment with the opening of the trousers at the right and diagonal to the vertical.

In FIG. 4 wherein parts identical or similar to those of FIG. 2 have been indicated with the same reference numerals increased by 500, there is represented another possible embodiment of the new construction for trousers, wherein the fifth added part 510' has a minimum extension.

As one may see, in it the cut of the two parts 514A, 514B which constitute the front parts has been modified, whilst the part 510' which constitutes the fifth part or added part is still constituted by a triangle with different length sides.

As one may easily understand, also in this embodiment the added part 510' is inserted in the finished trousers by sewing its top 532 to the lateral edge 534D of the curved cut 535 in the part 514B as a continuation in it of the crotch edge 528'B which originates from the apex 516B; its long side 531B to the whole of the edges 528'B, 534E and, finally, its short side 531A to the crotch edge 528'A of the right front part 514A. Naturally, it is possible to arrange also the right handed version of this embodiment, in the same manner as the set of versions shown in FIGS. 2 and 3.

It will be clear that, due to the inclined shape of the two edges 528A and 528B in both the versions of this embodiment in the finished trousers, the closure will be in a slanted position inclined to the right or to the left, respectively.

Figure 5:
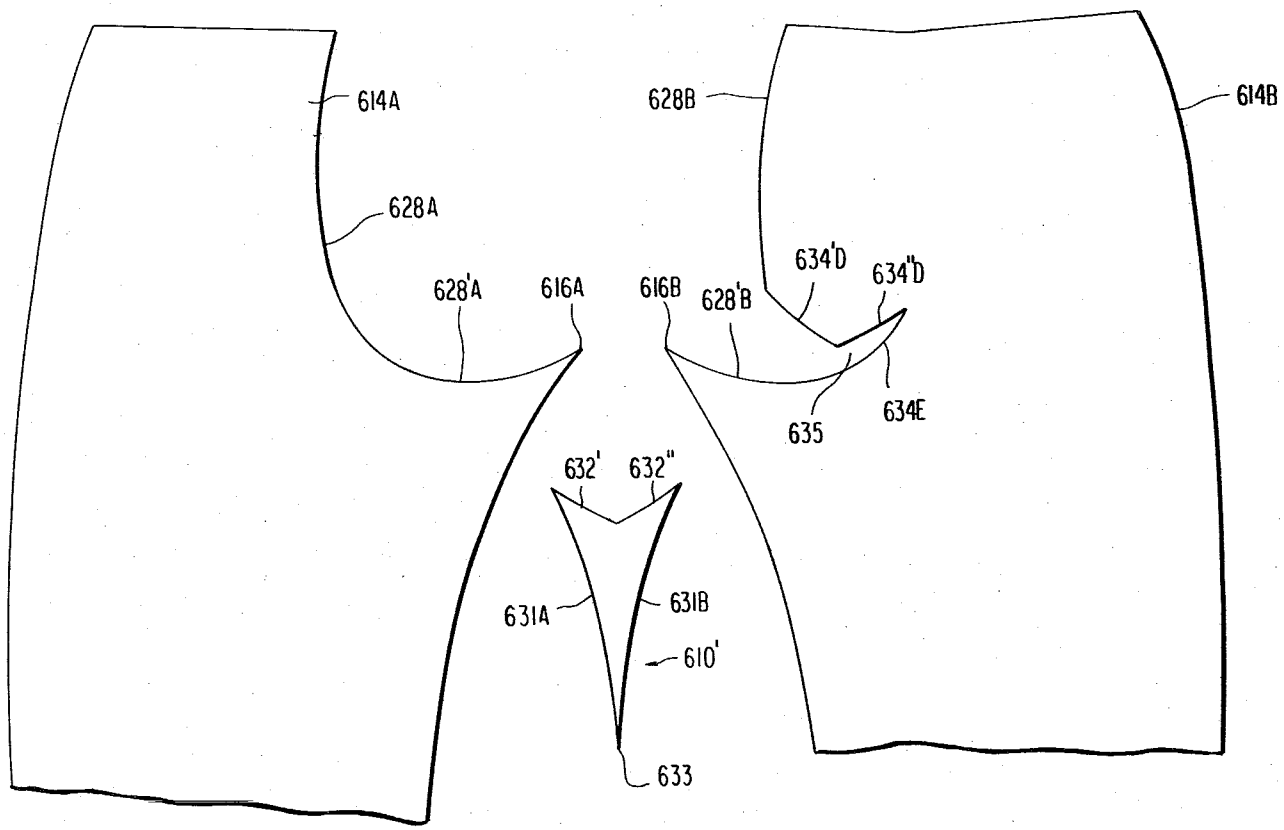
FIG. 5 is a partial view of a fifth added part having a shape as an arrow head and of the two related front parts in the left handed embodiment, for which the trousers have an opening to the right.

In FIG. 5 wherein parts similar or identical to those shown in FIG. 2 are indicated with reference numerals equal and increased by 600, there is disclosed yet another embodiment of the invention. In this embodiment, the fifth part or added part has a larger area a than in the earlier embodiments and has the shape of an arrow head, with its top made up of two V-shaped convergent edges, indicated with 632' and 632'' and the two crotch edges 631A and 631B having the same length.

In FIG. 5 there is shown the left handed version of this embodiment, in which the left front part 614B has an abdominal flap, and in it the fifth added part 610' will be united to this flap along the two convergent V-shaped edges 632' and 632'' and the left edge 631B. More precisely, the edges 632' and 632'' will be sewn to the edges 634'D and 634''D of the cut 635, they too convergent as a V; and the edge 631B will be sewn subsequently to the part 628'B and to the lower edge 634E of the cut 635. Finally, the edge 631 will be sewn to the lower part 628'A of the edge 628A of the right front part 614A.

In this version the closure of the trousers, provided with a suitable zipper (not shown) the halves of which will be united to the edges 628A, 628B, will be shifted to the right; it will be however apparent that the symmetrical version with the closure shifted to the left could be made.

Figure 5A:
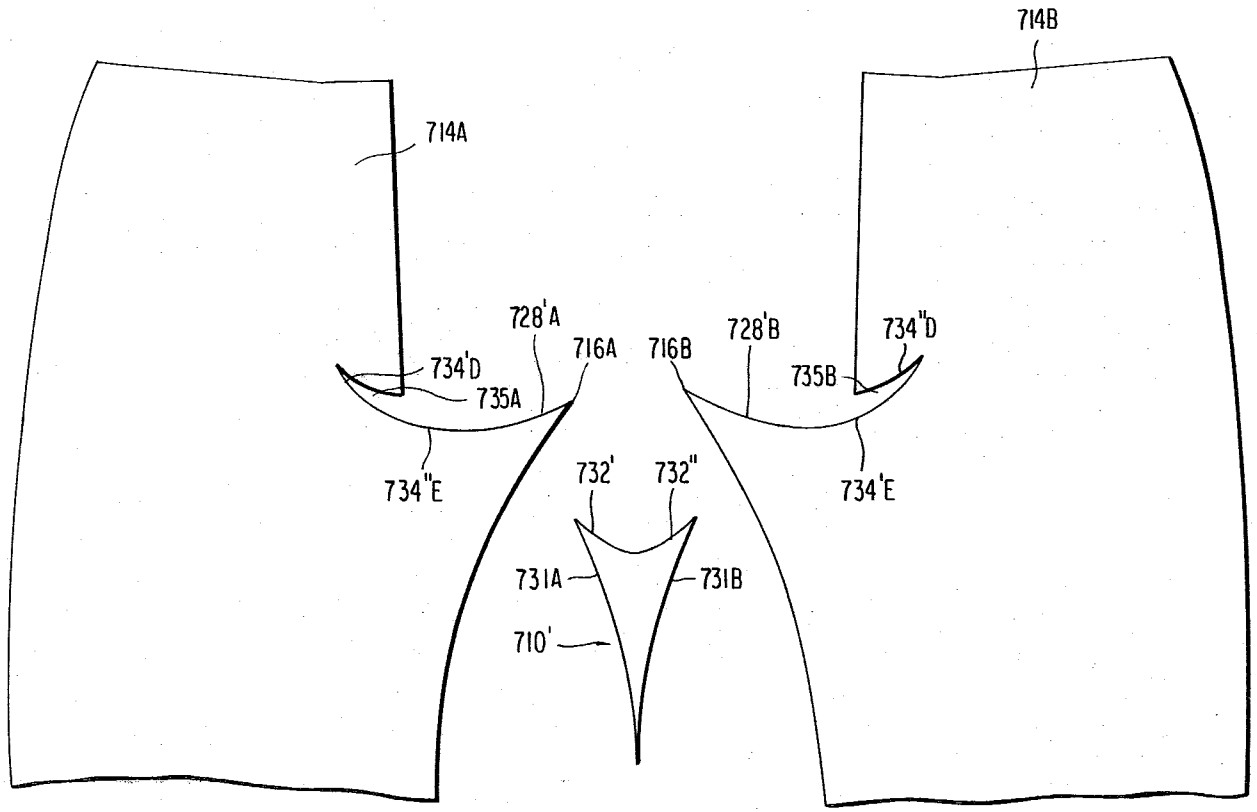
FIG. 5*a* is a partial view of a fifth added part having the shape of an arrow head and of the two related front parts in the embodiment for which the trousers have a central opening.

The embodiment shown in FIG. 5A is very similar to the one shown in FIG. 5, the only difference being constituted by the fact that the trousers obtained with it have a central closure which may be made of any desired length. For this purpose, the two front parts 714A, 714B are mirror images of one another, each having one half of the cut, thereby forming an abdominal flap on each front part with the two halves indicated with the references 735A and 735B respectively, whilst the fifth part 710' is identical to the part 610' of FIG. 5.

In the assembly step, the edges 732'' and 731B of the fifth added part will be sewn to the edge 734''D of the cut 735B and to the whole of the edge parts 728'B, 734'E pertaining to the front part 714B. The edges 732' and 731A will be sewn to the edge 734'D of the cut 735A and to the whole of the crotch edge 728'A and 734''E pertaining to the front part 714A.

Figure 6:
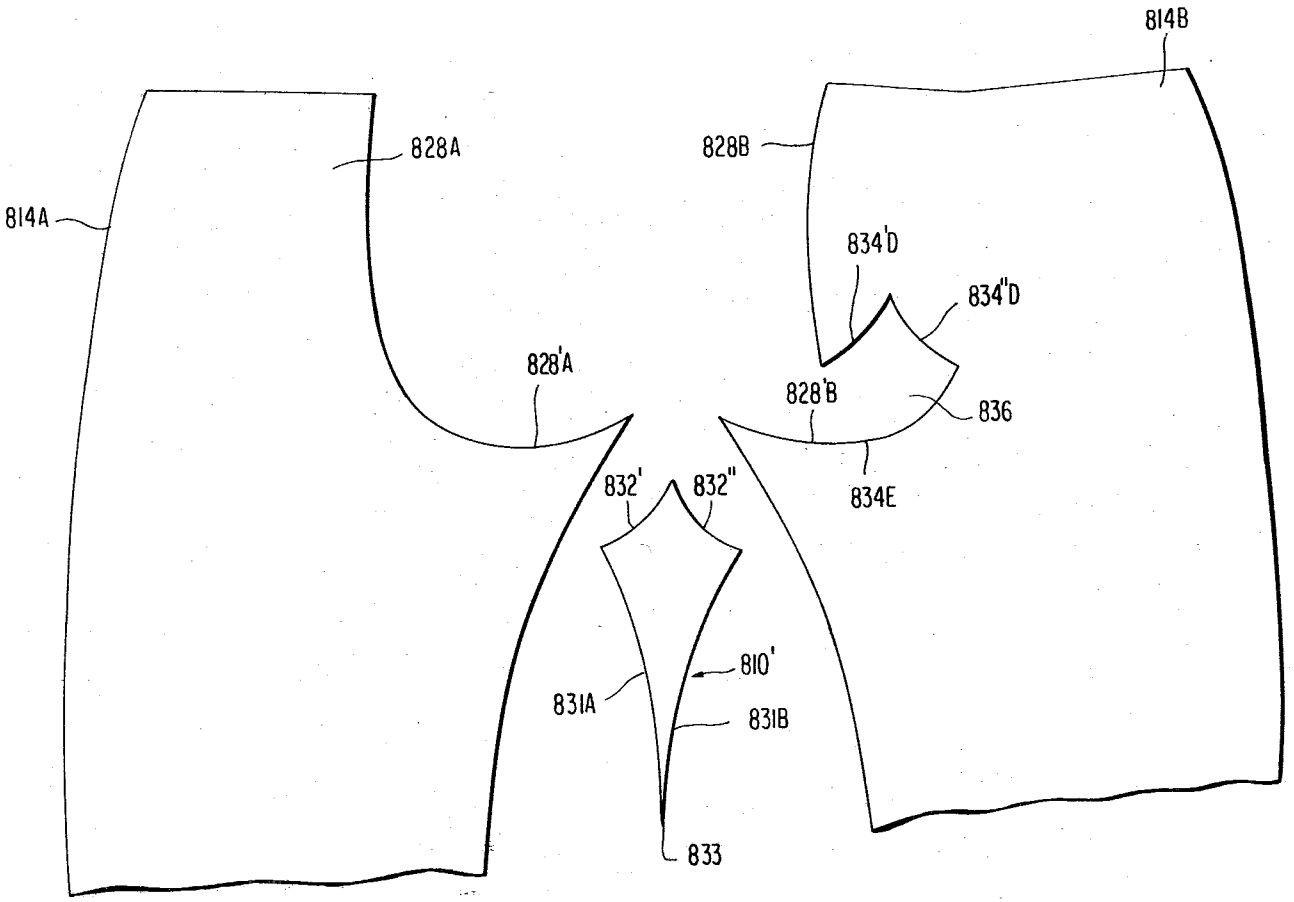
FIG. 6 is a partial view of a fifth added part having the shape of a point of a lance and the related front parts in the left handed embodiment, with opening of the trousers at the right.

In FIG. 6 where parts similar or identical to those shown in FIG. 2 are indicated by equal reference numerals increased by 800, there is shown a further embodiment of the invention in which the fifth added part 810' has a greater area and assumes the shape of the point of a lance with its top having two convergent edges as an inverted V and indicated with 832' and 832'', whilst the edges 831A, 831B have equal lengths.

In the figure there is shown the left handed version, in which the left front part 814B has an abdominal flap and in it there is completely formed a blanked out portion 836 the upper edge of which has a shape which is complementary with the one of the fifth part 810.

In it the edges 832' and 832'' will be united to the edges 834'D and 834''D of the blanked out portion 836 and the edge 831 will be united to the whole of the parts 828'B, 834E, all pertaining to the front part 814B, whilst the edge 831A will be sewn to the edge 828'A of the right front part 814A.

Figure 7:
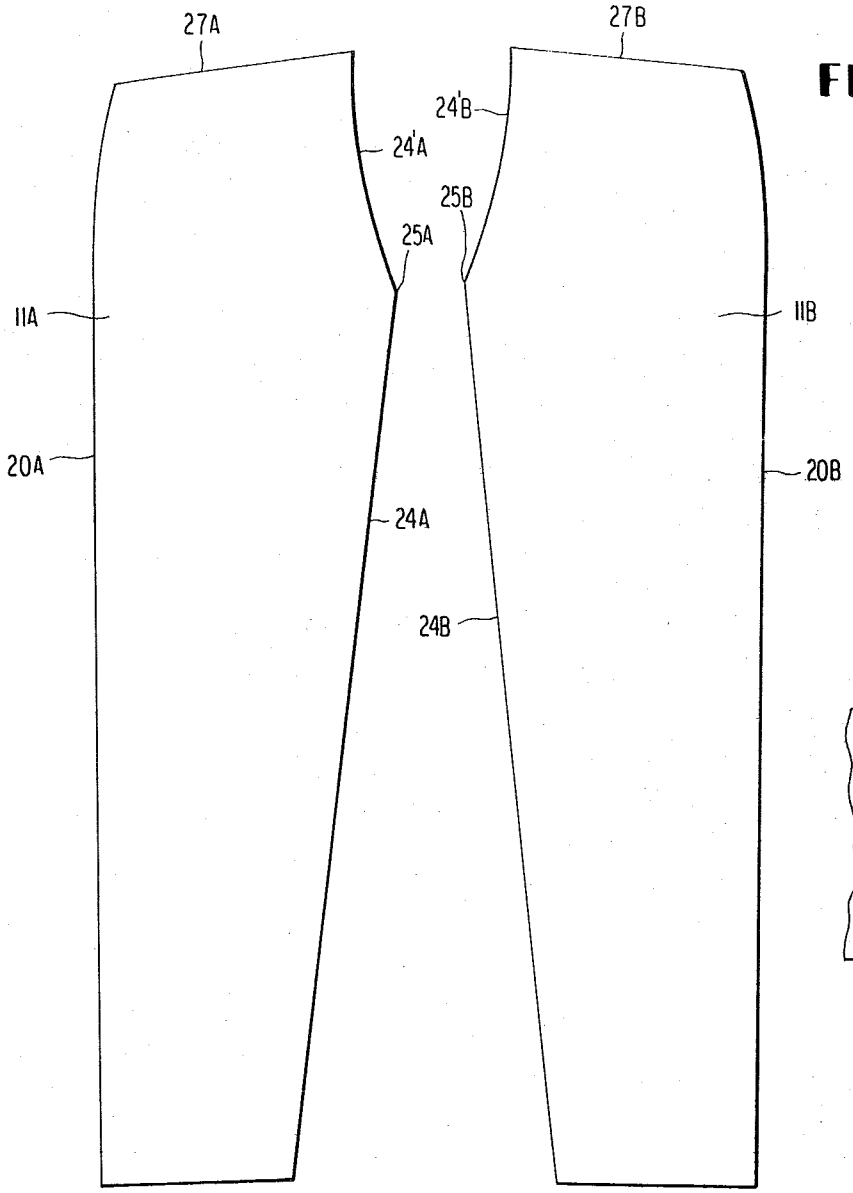
FIG. 7 is a view of the two back parts to be utilized in all the embodiments of the invention.

In FIG. 7 there are shown the two parts which constitute the rear part of the trousers according to the invention indicated with 11A and 11B. As one may note, these parts have an extension which is smaller than conventional rear parts and they have a contour along their inner sides which is much less pronounced, in which the apex 25A, 25B formed by the meeting of the lower and upper inner sides 24A, 24B and 24'A, 24'B is very flattened.

In FIG. 8 there is shown the sewn trousers in the version of FIG. 2. The encounter point 37 of the apexes 16B, 16A, 33, 25A, 25B, of the five parts constituting the trousers falls, in the seated position, in correspondence of the anatomic area called "perineum tendon centrum" (i.e. outside of the genital area) and, in the standing position immediately under the sacrum.

Finally, coming back to the representation of FIG. 1 there is shown the previously mentioned version, which is adaptable to all the disclosed embodiments. The opening or fly of the trousers with the usual zipper can extend down to the apex 33 of the crotch piece 10' as shown by the dotted line 8, cutting the fifth added part in two.

From the foregoing, it will be clear that it is a feature of the invention in all the possible versions that the overall extension of the crotch area is greater than in conventional trousers.

It will be clear that the invention is not strictly limited to the several versions and embodiments which have been disclosed and illustrated, but that the same is extended to all those solutions which make use, even partially, of the concepts and shapes which have been illustrated.

What is claimed is:

1. A trouser construction comprising right and left front parts and right and left rear parts for covering the respective front and rear of a wearer's right and left hip and thigh, each said rear part having a top edge, a bottom edge, an outer edge extending substantially continuously between said top and bottom edges, a lower inner edge extending from said bottom edge to a region corresponding to the sacrum of the wearer and an upper inner edge extending from the region corresponding to the sacrum to the top edge, each said front part having a central portion, a top edge, a bottom edge, an outer edge extending substantially continuously between said top and bottom edges, a lower inner edge extending from the bottom edge to the region of the sacrum of the wearer, said lower inner edge slanting away from said central portion in the region of the thigh of the wearer, a concave crotch edge extending from the region of the sacrum toward said central portion, and an upper inner edge extending from said crotch edge to said top edge, an elongated crotch piece having a multiplicity of sides including elongated right and left continuous concave sides converging at one end thereof in an acute angle, the remainder of said sides forming a crotch piece top, wherein said right and left front parts have their upper inner edges shaped for complementary construction with said crotch piece top across the abdomen of the wearer, said right front and rear parts are joined by a right outer seam along their outer edges and by a right inseam along their lower inner edges, said left front and rear parts are joined by a left outer seam along their outer edges and by a left inseam along their lower inner edges, said right and left rear parts are joined by a back seam along their upper inner edges, said right front part is joined to said crotch piece by a right crotch joint along the crotch edge of said right front part and said right converging side of said crotch piece, said left front part is joined to said crotch piece by a left crotch joint along the crotch edge of said left front part and said left converging side of said crotch piece, whereby said back seam, said inseams and said crotch joints converge in the region of the sacrum, said acute angle of said converging sides of said crotch piece points rearwardly and said right and left crotch joints extend along anatomical lines from said sacrum to positions on the sides of the navel of the wearer, and said right and left front parts have their upper edges joined with said crotch piece top in complementary connection across the abdomen of the wearer.

2. A trouser construction as claimed in claim 1 wherein said crotch piece top includes a top edge substantially colinear with the top edges of said front parts, said elongated right and left continuous concave sides of said crotch piece continue upward along convex anatomical lines to said top edge of said crotch piece, and said right and left front parts have their upper inner edges as upward concave continuations of their crotch edges, whereby said upper inner edge of each front part is joined to one of said upward continuations of said right and left continuous sides of said crotch piece in complementary construction across the abdomen of the wearer.

3. A trouser construction as claimed in claim 2 in which a zipper is provided along a joint between a front part and said crotch piece.

4. A trouser as claimed in claim 3 wherein said zipper extends back towards the region of the sacrum.

5. A trouser construction as claimed in claim 1 wherein the upper inner edge of one front part extends upwardly from the crotch edge of said one front part to the top edge thereof, the other front part includes an abdominal flap extending laterally toward said upper inner edge of sid one front part and being bounded by said top edge and said upper inner edge of said other front part, said upper inner edge of said other part including a vertical edge adapted for complementary construction with said upper inner edge of said one front part and a lateral edge extending from said vertical edge to said crotch edge of said other part, forming a blanked out portion between said lateral edge and said crotch edge of said other front part and said crotch piece top is adapted for complementary construction with said lateral edge of said abdominal flap.

6. A trouser construction as claimed in claim 5 wherein said lateral edge is the convex complement formed when cutting the concave crotch edge in said other front part, and said crotch piece is triangular, such that said top is a third concave side sewn to said lateral edge.

7. A trouser construction as claimed in claim 6 wherein one of said elongated right and left continuous concave sides of said crotch piece is shorter than the other, the one shorter side is sewn to said crotch edge of said one front part, and the other longer side is sewn to the crotch edge of said other front part.

8. A trouser construction as claimed in claim 7 wherein said upper inner edge of said one front part is joined to said vertical edge of said abdominal flap of the other front part by a zipper.

9. A trouser construction as claimed in claim 8 wherein said zipper extends back along the joint of said crotch piece and said one front part towards the region of the sacrum.

10. A trouser construction as claimed in claim 5 wherein said upper inner edge of said one front part extends diagonally upwardly from the crotch edge to the top edge and the vertical edge of said other front part extends diagonally upwardly from said lateral edge to said top, substantially parallel to said upper inner edge of said one front part.

11. A trouser construction as claimed in claim 10 wherein said upper inner edge of said one front part and said vertical edge are joined by a zipper.

12. A trouser construction as claimed in claim 5 wherein said lateral edge of said abdominal flap is convexly V-shaped and said crotch piece top is concavely V-shaped.

13. A trouser construction as claimed in claim 12 wherein said upper inner edge of said one front part and said vertical edge of said flap are joined by a zipper.

14. A trouser construction as claimed in claim 13 wherein said zipper extends back along the joint of said crotch piece and said one front piece towards the region of the sacrum.

15. A trouser construction as claimed in claim 5 wherein said lateral edge of said abdominal flap is concavely V-shaped and said crotch piece top is convexly V-shaped.

16. A trouser construction as claimed in claim 15 wherein said upper inner edge of said one front piece and said vertical edge of said flap are joined by a zipper.

17. A trouser construction as claimed in claim 16 wherein said zipper extends back along the joint of said crotch piece and said one front piece towards the region of the sacrum.

18. A trouser construction as claimed in claim 1 wherein each front part includes an abdominal flap extending laterally toward the abdominal flap of the other front part, each abdominal flap bounded by the top edge and the upper inner edge of its respective front part, each said upper inner edge including a vertical edge adapted for complementary construction with the vertical edge of the other flap and a lateral edge extending from said vertical edge to said crotch edge of its respective front part, forming a blanked out portion between said lateral edge and said crotch edge of said front part and said crotch piece top is adapted for complementary construction with said lateral edges of said abdominal flaps and sewn thereto.

19. A trouser construction comprising right and left front parts and right and left rear parts for covering the respective front and rear of a wearer's right and left hip and thigh, each said rear part having a top edge, a bottom edge, an outer edge extending substantially continuously between said top and bottom edges, a lower inner edge extending from said bottom edge to a region corresponding to the sacrum of the wearer and an upper inner edge extending from the region corresponding to the sacrum to the top edge, each said front part having a central portion, a top edge, a bottom edge, an outer edge extending substantially continuously between said top and bottom edges, a lower inner edge extending from the bottom edge to the region of the sacrum of the wearer, said lower inner edge slanting away from said central portion in the region of the thigh of the wearer, a concave crotch edge extending from the region of the sacrum toward said central portion, and an upper inner edge extending from said crotch edge to said top edge, an elongated crotch piece having a multiplicity of sides including elongated right and left continuous sides which are not outwardly convex and which converge at one end thereof in an actue angle, the remainder of said sides forming a crotch piece top, wherein said right and left front parts have their upper inner edges shaped for complementary connection with said crotch piece top across the abdomen of the wearer, said right front and rear parts are joined by a right outer seam along their outer edges and by a right inseam along their lower inner edges, said left front and rear parts are joined by a left outer seam along their outer edges and by a left inseam along their lower inner edges, said right and left rear parts are joined by a back seam along their upper inner edges, said right front part is joined to said crotch piece by a right crotch joint along the crotch edge of said right front part and said right converging side of said crotch piece, said left front part is joined to said crotch piece by a left crotch joint along the crotch edge of said left front part and said left converging side of said crotch piece, whereby said back seam, said inseams and said crotch joints converge in the region of the sacrum, said acute angle of said converging sides of said crotch piece points rearwardly and said right and left crotch joints extend along anatomical lines from said sacrum to positions on the sides of the navel of the wearer, and said right and left front parts have their upper edges joined with said crotch piece top in complementary connection across the abdomen of the wearer.

* * * * *